US007257868B2

(12) United States Patent
Yoneshima

(10) Patent No.: US 7,257,868 B2
(45) Date of Patent: Aug. 21, 2007

(54) SLIDER FOR CONCEALED TYPE SLIDE FASTENER AND CONCEALED TYPE SLIDE FASTENER

(75) Inventor: Hisashi Yoneshima, Taipei (TW)

(73) Assignee: YKK Corporation, Tokyo (JP)

( * ) Notice: Subject to any disclaimer, the term of this patent is extended or adjusted under 35 U.S.C. 154(b) by 18 days.

(21) Appl. No.: 11/166,819

(22) Filed: Jun. 24, 2005

(65) Prior Publication Data

US 2006/0000067 A1 Jan. 5, 2006

(30) Foreign Application Priority Data

Jul. 5, 2004 (JP) ..... 2004-198373

(51) Int. Cl.
*A44B 19/26* (2006.01)
*A44B 19/34* (2006.01)

(52) U.S. Cl. ..... 24/415; 24/432

(58) Field of Classification Search ..... 24/413, 24/405, 401, 415
See application file for complete search history.

(56) References Cited

U.S. PATENT DOCUMENTS

| | | | | |
|---|---|---|---|---|
| 1,817,837 | A * | 8/1931 | Poux | 24/413 |
| 3,696,473 | A * | 10/1972 | Jones | 24/413 |
| 3,768,125 | A * | 10/1973 | Frohlich | 24/396 |
| 3,798,715 | A | 3/1974 | Moertel | |
| 4,143,680 | A * | 3/1979 | Murai et al. | 24/396 |
| 4,267,621 | A * | 5/1981 | Akashi | 24/396 |
| 4,455,722 | A * | 6/1984 | Oda | 24/415 |
| 4,488,338 | A * | 12/1984 | Takahashi | 24/389 |
| 5,008,986 | A | 4/1991 | Laudet et al. | |
| 5,083,349 | A * | 1/1992 | Axtell | 24/415 |
| 5,699,592 | A * | 12/1997 | Shimono | 24/393 |
| 6,205,626 | B1 * | 3/2001 | Watanabe et al. | 24/398 |
| 2003/0000049 | A1 * | 1/2003 | Ichikawa | 24/389 |

FOREIGN PATENT DOCUMENTS

| | | |
|---|---|---|
| EP | 1036517 | 9/2000 |
| EP | 1430804 | 6/2004 |
| JP | 3439605 | 6/2003 |

* cited by examiner

*Primary Examiner*—Robert J. Sandy
(74) *Attorney, Agent, or Firm*—Everest Intellectual Property Law Group; Michael S. Leonard

(57) ABSTRACT

A slider of a concealed type slide fastener and the concealed type slide fastener, wherein the slider engages/disengages respective fastener element rows of the concealed type slide fastener, in which fastener elements are continuously attached to folded-back pieces on a rear face side of respective folded-back side edge portions formed in a double structure created by folding back opposing side edge portions of a pair of right and left fastener tapes into a U shape; the slider has upper and lower blades connected through a connecting post, flanges provided at right angle to respective right and left side edges of the lower blade and approaching toward the upper blade, and between the upper and lower blades guide passages for guiding the folded-back side edge portions and the fastener element rows simultaneously.

9 Claims, 8 Drawing Sheets

SLIDER FOR CONCEALED TYPE SLIDE FASTENER AND CONCEALED TYPE SLIDE FASTENER

BACKGROUND OF THE INVENTION

1. Field of the Invention

The present invention relates to a slider preferable for a concealed type slide fastener and the concealed type slide fastener equipped with the same slider.

2. Description of the Related Art

Conventional typical slide fasteners are classified broadly into two types, i.e. a normal type and a concealed type. In a normal type slide fastener 100, as shown in FIG. 8, a multiplicity of fastener elements 102 are mounted across the front surfaces or front and rear surfaces of opposing element mounting edge portions of two fastener tapes 101 so as to constitute right and left fastener stringers 103. Each of the fastener elements 102 of the right and left fastener stringers 103 is inserted through a guide passage of a slider 104 together with an element mounting edge portion of a fastener tape 101. The slider 104 includes a slider body 105 and a pull tab 106 attached to the same slider body 105.

The slider body 105 has upper and lower blades 105*a*, 105*b* and a connecting post 105*c* for connecting the upper and lower blades 105*a*, 105*b*. This connecting post 105*c* connects the upper and lower blades 105*a*, 105*b* and in a space between the upper and lower blades 105*a* and 105*b*, defines a Y-shaped element guide passage in which right and left shoulder mouths for separating and passing right and left fastener element rows 107 of the right and left fastener stringers 103, the fastener element rows constituted of a multiplicity of the fastener elements 102, separately and a rear mouth for passing the engaged fastener element rows 107 are communicated with each other. At right and left side edges of the upper and lower blades 105*a*, 105*b*, there are provided upper and lower flanges 105*a*-1, 105*b*-1 which are at right angle to the upper and lower blades 105*a*, 105*b* and approaching each other. The fastener tape 101 is passed through a gap between the upper and lower flanges 105*a*-1 and 105*b*-1 entirely across both inside and outside of the slider body 105.

That is, in this normal type slide fastener 100, the fastener element row 107 disposed on the same plane of the fastener tape 101 is passed through the element guide passage of the slider body 105 without folding back the fastener tape 101. Thus, whether the slide fastener 100 is opened or closed, the fastener elements 102 are exposed outside. At the same time, a sewing thread 108 of the fastener element row 107 with respect to the fastener tape 101 is also exposed outside.

On the other hand, in recent years, use of the concealed type slide fastener in which the fastener elements are invisible from a surface side of the slide fastener has been demanded more and more in design viewpoints and this concealed type slide fastener has been used in clothes, shoes and the like frequently. An example of an ordinary concealed type slide fastener has been disclosed in, for example, Japanese Patent No. 3439605 (patent document 1). In case of a concealed type slide fastener 200, as shown in FIG. 9, folded-back side edge portions 201*a* are formed by folding back the opposing element mounting edge portions of two fastener tapes 201 into a U shape along a length direction thereof and a multiplicity of fastener elements 202 are attached to a bottom face side of folded-back pieces 201*a*-1 of the folded-back side edge portions 201*a* so as to constitute right and left fastener stringers 203.

Each of fastener element rows 204 of the right and left fastener stringers 203 is passed through the guide passage of a slider 205 together with the folded-back piece 201*a*-1 of the fastener tape 201. At this time, other portion of each fastener tape 201 than the folded-back piece 201*a*-1 and the fastener element row 204 covers the front surface side of a slider body 206. Thus, the body 206 of the slider 205 applied for this kind of the concealed type slide fastener is usually provided with a guide post 206*c* which is extended from the shoulder mouth to the rear mouth in the central portion in the right and left direction of the lower blade 206*b*, and element guide flanges 206*d* each having an inverted L shaped section, the element guide flanges comprising rising portions 206*d*-1 which rise along right and left side edges of the lower blade 206*b* and horizontal portions 206*d*-2 extended horizontally from top ends of the rising portions in a direction of approaching each other.

A pull tab mounting portion 206*c*-1 is provided protrudedly on a top face of the guide post 206*c* and a pull tab 207 is mounted on the same pull tab mounting portion 206*c*-1 such that it can be moved freely in a back and forth direction. This pull tab mounting portion 206*c*-1 is projected upward between the opposing tape folded-back portions of the right and left fastener stringers 203. Thus, the fastener element rows 204 and their sewing threads are hidden behind the rear face of the fastener tapes so that they are invisible from outside and when the slide fastener 200 is closed, an opening/closing portion of a product on which the same fastener 200 is mounted is exposed only in the form of a seam line, thereby providing a neat appearance.

However, instead of the concealed type slide fastener having such a complicated structure, for example, a concealed type slide fastener proposed in U.S. Pat. No. 5,008,986 (patent document 2) has been known. According to the patent document 1, without changing the structure of the upper and lower blades in the ordinary slide fastener shown in FIG. 8, the fastener element row attached to the top face side of the fastener tape is attached to the bottom face side thereof. However, only if the fastener element row is attached to the bottom face side of the fastener tape, a gap is generated between opposing side edges of the fastener tapes and as a consequence, the fastener element row is still visible through that gap from outside.

According to the same document 1, the side edges of the fastener tapes are extended more to the coupling head side of the fastener elements than the normal position, and when the slide fastener is opened or closed, particularly when closed, the opposing side edges of the fastener tapes press each other so that they makes firm contact with each other and as a consequence, the fastener element rows are invisible from outside. Further, if the fastener tape is provided with waterproofness, no water enters via the fastener elements through the gap between the side edges because the opposing side edges of the fastener tapes press each other so that they make firm contact with each other and consequently, this is a structure suitable for shoes, waterproof clothing and the like.

However, according to the patent document 2, although the fastener element row is located on the bottom face of the fastener tape, because it is sewed with sewing thread without folding back the fastener tape, that sewing thread itself is exposed on the surface. If the concealed type slide fastener disclosed in the patent document 2 is adopted to a product which strikes violently and repeatedly such as various kinds of sport shoes, if the sewing thread is exposed outside as described above, an external force is applied to the same sewing thread or the sewing thread is caught by a tool nearby so that it is likely to be cut out. Further, if the same slide fastener is adopted to for example waterproof clothes, water is likely to enter through the seam line because the seam line is exposed outside, so that no expected waterproof effect is obtained.

On the other hand, in case of the slider 205 of concealed type slide fastener having an ordinary structure shown in FIG. 9, if it is intended to adopt this to clothing which is fit to human body such as shoes, the inside face of the folded-back portion of the folded-back side edge portion 201*a* having the U-shaped section of the fastener tape 201 comes into firm contact with an end of a horizontal portion 206*d*-2 of an inverted L-shaped flange portion 206*d* rising from each of the right and left edges of the lower blade 206*b* of the slider 205 during its sliding and consequently, sliding resistance is increased so that wear is accelerated at that portion thereby possibly affecting the durability. Further, in case of the concealed type slide fastener 200 having this ordinary structure, if a pulling force in a width direction of the fastener tape is applied to the fastener tape 201, a portion continuous from the tape main portion of the folded-back side edge portion 201*a* is pulled strongly by the end of the horizontal portion 206*d*-2 of the inverted L-shaped flange portion 206*d,* so that the fastener element 202 existing among the lower blade 206*b,* the guide post 206*c* and the inverted L-shaped flange portion 206*d* is easily raised obliquely and its stable posture cannot be maintained. As a result, this can affect the engagement of the fastener elements 202 or the folded-back side edge portion 201*a* which is folded back into the U shape is deformed in an opening direction thereby damaging the appearance in fashion viewpoints.

SUMMARY OF THE INVENTION

The present invention has been accomplished to solve various kinds of problems concerning a particular structure of the conventional slider for the concealed type slide fastener and an object of the invention is to provide a slider for a concealed type slide fastener having an excellent design performance in which not only a seam line but also any sewing thread are not exposed outside and having an excellent operability for opening and closing the slide fastener, and a slide fastener having an excellent durability using the same slider.

Such an object is achieved by a basic configuration of a slider for a concealed type slide fastener of the present invention, namely, a slider for a concealed type slide fastener, the slider engaging and disengaging respective fastener element rows of the concealed type slide fastener in which fastener elements are continuously attached to folded-back pieces on a rear face side of respective folded-back side edge portions formed in a double structure created by folding back opposing side edge portions of a pair of right and left fastener tapes into a U shape, the slider including: an upper blade and a lower blade connected through a connecting post; lower flanges provided at right angle to right and left side edges of the lower blade and approaching toward the upper blade; and between the upper blade and the lower blade, guide passages for guiding the respective folded-back side edge portions in the double structure of the fastener tapes and the respective fastener element rows in an engageable/disengageable posture.

Further, according to the basic configuration of the concealed type slide fastener of the invention equipped with the aforementioned slider comprises: a pair of right and left fastener tapes including folded-back side edge portions in a double structure created by being folded back into a U shape along side edges thereof and including tape main bodies except the side edge portions; right and left fastener element rows attached along folded-back pieces of the folded-back side edge portions; and a slider which is slid along the fastener element row and carries out an engagement/disengagement of the right and left fastener element rows, wherein the slider has an upper blade and lower blade connected by a connecting post, and flanges provided at right angle to right and left side edges of the lower blade and approaching the upper blade, and between the upper blade and the lower blade, guide passages for guiding the respective folded-back side edge portions in the double structure of the fastener tapes and the respective fastener element rows attached to the folded-back pieces in an engageable/disengageable posture.

In the slider of the invention, a gap in a vertical direction at each of right and left side edges between the upper and lower blades is set to such a dimension allowing only a fastener tape main body except the folded-back side edge portion to be passed through. Further, in the slider of the invention, it is preferable that protrusions, which are disposed along top portions of right and left side faces of the connecting post and on the upper blade so as to be protruded from the upper blade toward the lower blade, is provided; element guide spaces for guiding the fastener element rows in the engageable/disengageable posture are formed between bottom end faces of the protrusions and the lower blade, and the spaces surrounded by the side faces of the protrusions, the element guide spaces and the upper blade constitute tape-side-edge-portion guide spaces for accommodating the folded-back side edge portions of the respective fastener tapes, while the engageable/disengageable posture of the fastener element rows are maintained. According to a further preferred aspect, the bottom end faces of the protrusions are formed as inclined faces, each of the inclined faces being inclined upward from an inner side of each of the element guide spaces to an outer side thereof. Further, it is permissible that expanded rows are extended on bottom faces of right and left portions of the upper blade in a back and forth direction of the slider, the expanded rows being expanded obliquely downward from the connecting post to an outer side.

According to the slide for the concealed type slide fastener of the invention, because the folded-back side edge portions of the fastener tapes are accommodated in the right and left guide passages between the upper and lower blades across the connecting post, in such a condition that the folded-back side edge portions are folded back in a double structure, together with the fastener elements attached to the folded-back pieces, no local closely contact sliding force is applied to the folded-back portions of the folded-back side edge portions by end edges of the horizontal portions of the inverted-L shaped flange portions unlike conventionally and even if a strong pulling force in a right and left direction is applied to the right and left fastener tapes, the fastener elements are never raised obliquely or the folded-back portions of the fastener tapes are never opened. As a consequence, the sliding operation of the slider is carried out smoothly and the fastener elements can be engaged or disengaged securely. Further, the durability of the tape is intensified and the appearance of a product equipped with the concealed type slide fastener of the present invention is never damaged.

By providing with the protrusions which are protruded from the upper blade to the lower blade along the right and left side faces of the connecting post, the element guide spaces for guiding the fastener element rows are defined between the bottom end faces of the protrusions and the lower blade and the spaces surrounded by the side faces of the protrusions, the element guide spaces and the upper blade can be defined as tape-side-edge-portion guide spaces for accommodating and guiding the folded-back side edge portions of the fastener tapes. As a result, the fastener elements are never raised within the element guide spaces unintentionally. Thus, while the fastener element rows are guided and slid within the element guide spaces, the folded-back side edge portions in the U shape of the fastener tapes are guided and slid independently of the fastener elements through the tape-side-edge-portion guide spaces. Consequently, the sliding postures of both are maintained at a constant condition so that the engagement and disengagement of the fastener elements are carried out smoothly.

If the bottom end faces of the protrusions are formed as inclined faces which are inclined upward from the inner side of the element guide passages toward the outer side thereof, the configurations of the folded-back side edge portions in the U shape of the fastener tapes slid and guided through the tape-side-edge-portion guide spaces are stabilized. Further, even if the fastener elements are about to be raised so that they come into contact with the bottom end faces of the protrusions, the fastener elements are never damaged because this bottom ends are formed as the inclined faces.

If the expanded rows are extended on the bottom faces of right and left portions of the upper blade in the back and forth direction of the slider, the expanded rows being expanded obliquely downward from the inner side of the element guide passages toward the outer side thereof, when a force in right and left directions is applied to the right and left fastener tapes, that is, a lateral pulling force is applied to the concealed type slide fastener chain so that the fastener elements are about to tilt, the fastener tapes make surface contact with the expanded rows so as to increase friction resistance on the fastener tapes thereby making it difficult for the fastener elements to tilt. Because the fastener tapes make surface contact along the inclined bottom faces of the expanded rows, the fastener tapes are protected from damage.

If the gap between each of the flanges of the lower blade and the upper blade is set to the dimension allowing the fastener tape main body except each of the folded-back side edge portions to be passed through, the slider can be slid smoothly without changing the accommodation style of the folded-back side edge portion and fastener elements of the fastener tape accommodated in the slider.

DESCRIPTION OF THE PREFERRED EMBODIMENTS

Hereinafter, the preferred embodiments of the slider for the concealed type slide fastener of the invention will be described in detail with reference to the accompanying drawings.

Figure 1:
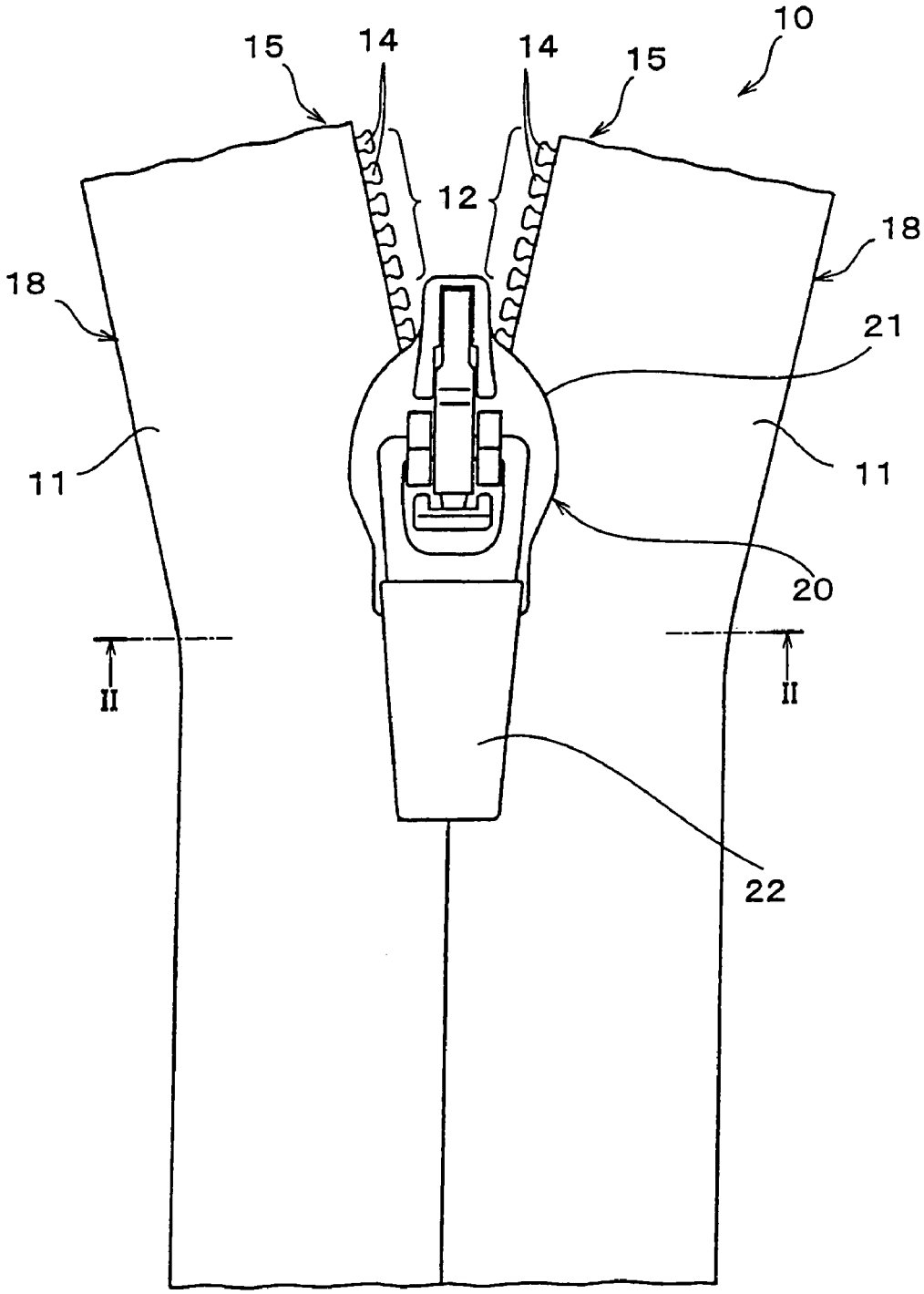
FIG. 1 is a top view of a part of a concealed type slide fastener of the present invention.

FIG. 1 is a plan view showing a part of a concealed type slide fastener 10 equipped with a slider 20 of the invention. As understood from this Figure, if taking a glance at the same slide fastener 10, an upper blade 21 of the slider 20 is exposed on a front surface side of fastener tapes 11 and the same upper blade 21 has a pull tab 22. Thus, this presents an appearance similar to a normal type slide fastener. However, if observing in detail, in such a condition that right and left fastener stringers 18 are closed with fastener element rows 12 being engaged, the fastener element rows 12 are completely invisible from the front surface side of the slide fastener 10. From this point, it can be estimated that the slide fastener 10 shown in the same Figure is a concealed type slide fastener.

The basic structure of the concealed type slide fastener 10 of this embodiment shown in FIG. 1 will be described in detail with reference to FIGS. 2 to 6.

Figure 2:
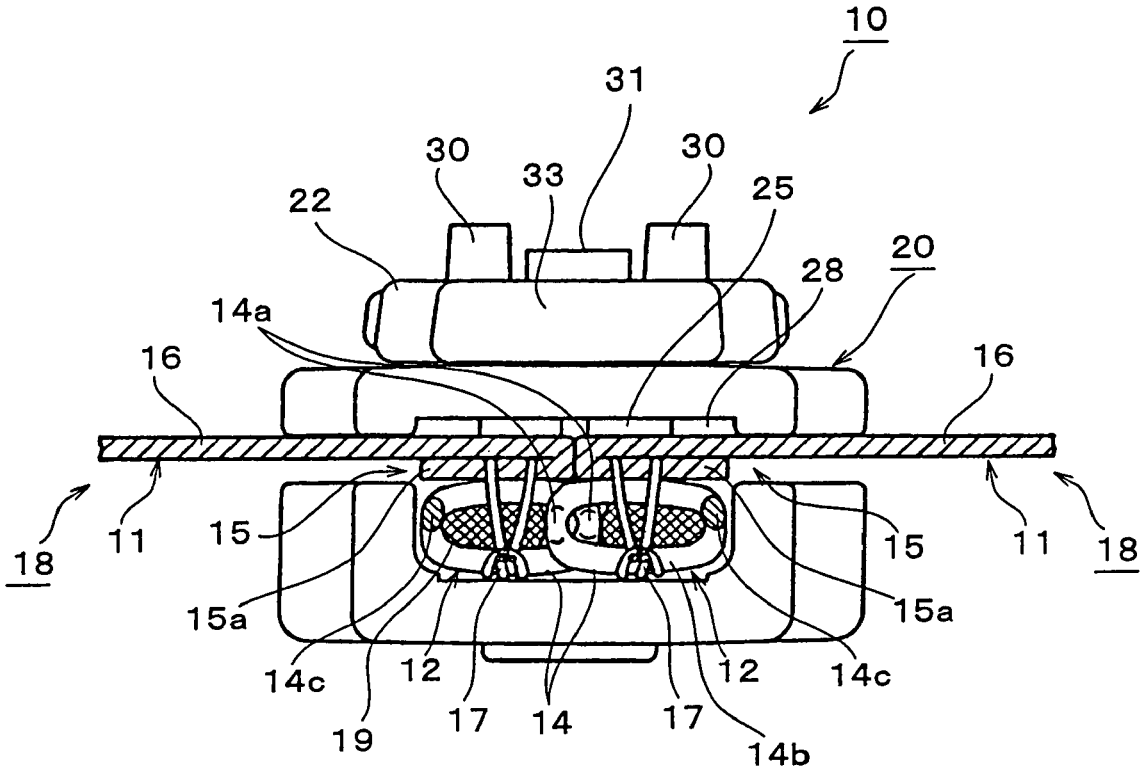
FIG. 2 is a sectional view taken along the line II-II in FIG. 1.
Figure 3:
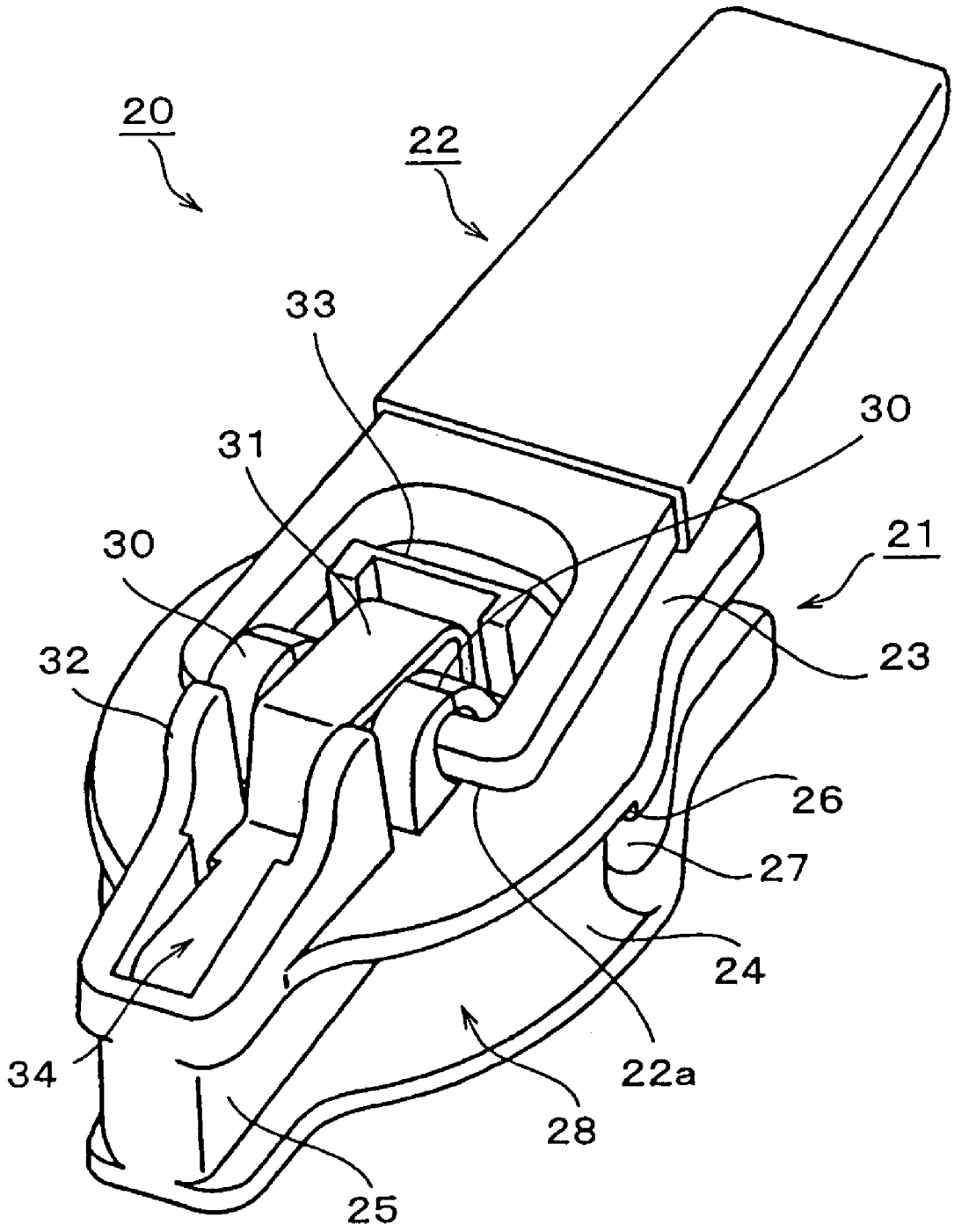
FIG. 3 is a perspective view of the concealed type slide fastener slider of a preferred embodiment of the invention as seen obliquely from an upside.

FIG. 2 is a sectional view taken along the line II-II of FIG. 1. This Figure shows a sectional view of a part of the concealed type slide fastener 10 according to this embodiment indicating fastener elements 14 in engagement condition within the slider as seen from the rear mouth side of the slider 20.

Referring to the same Figure, opposing side edges of a pair of right and left fastener tapes 11 are both folded back downward and in this specification, these folded-back portions are called folded-back side edge portions 15. That is, these folded-back side edge portions 15 refer to entire folded-back portions including folded-back pieces 15*a* which are folded back into a U shape after extended from tape main bodies 16. After side edge portions of the fastener tapes 11 are folded back as described above, their configurations are fixed permanently by heat setting or the like. The fastener element rows 12 are sewed according to multi-thread chain stitch onto the bottom faces of the folded-back pieces 15*a* of the folded-back side edge portions 15 with a sewing thread 17 so that they are integrated with the folded-back pieces 15*a* and as a consequence, the right and left fastener stringers 18 are constructed. Even in the fastener tapes of the concealed type slide fastener 10 of this embodiment, like the conventional one, tape portions extending from the tape main bodies 16 of the folded-back side edge portions 15 are floating from the folded-back pieces 15*a*, so that they are not sewed with the sewing thread 17. In the meantime, reference numeral 19 in FIG. 2 designates a core thread passed through an inside of a coil of the fastener element row 12.

The fastener elements 14 of this embodiment sewed on the bottom face of the folded-back piece 15*a* are constituted of the continuous fastener element row 12 in which a single mono-filament made of thermoplastic resin is molded into a coil and coupling heads 14*a* are disposed on part of respective coil portions linearly. That is, each of the coil portions constituting the respective fastener elements 14 comprises the coupling head 14*a,* upper and lower leg portions 14*b* extended substantially horizontally from upper and lower portions of the coupling head and a connecting portion 14*c* which connects the upper and lower leg portions 14*b* of adjacent fastener elements 14.

On the other hand, the slider 20 of this embodiment which is a characteristic portion of the invention which guides the fastener element rows 12 of the right and left fastener stringers 18 having the above-described structure so as to engage and disengage opposing fastener elements 14 comprises a slider body 21 and a pull tab 22 as shown in FIGS. 2 to 5. The slider body 21 has an upper blade 23, a lower blade 24 and a connecting post 25 which connects the upper and lower blades 23, 24 in a central portion. Upper and lower flanges 26, 27, each paired of right and left ones, are formed on right and left side ends of the upper blade 23 and the lower blade 24 such that they are extended at right angle to the upper and lower blades 23, 24 in a direction of approaching each other. A gap is provided between the upper and lower flanges 26, 27 and this gap is set to such a dimension enough for only a tape main body 16 of the fastener tape 11 to pass through. Although according to this embodiment, the upper and lower flanges 26, 27 are formed on the right and left side edges of both the upper and lower blades 23, 24, the flanges 27 may be formed on only the lower blade without forming the flanges 26 on the upper blade 23. In this case, the gap between the lower flange 27 of the lower blade 24 and the upper blade is set to a dimension enough for only the tape main body 16 to pass through.

Y-shaped guide passages 28 are formed among the connecting post 25, the upper/lower blades 23, 24 and the respective flanges 26, 27, such that separate passages are joined together to a single passage from a shoulder mouth to a rear mouth. In this embodiment also, the most important point exists in existence of the upper blade 23 and the height of the guide passage 28. If comparing the slider structure and the guide passage 28 of the present invention with the structure and element guide passage of the conventional concealed type slide fastener slider 205 shown in FIG. 9, there exists an evident difference. The slider 20 of the present invention is provided with the flat upper blade 23 continuous flatly like the normal type slide fastener slider 100 shown in FIG. 8 and if comparing with the element guide passage in the normal type slide fastener slider shown in FIG. 8 or the ordinary concealed type slide fastener slider 205 shown in FIG. 9, the height dimension of the guide passage 28 in the present invention is set to a larger one.

Figure 8:
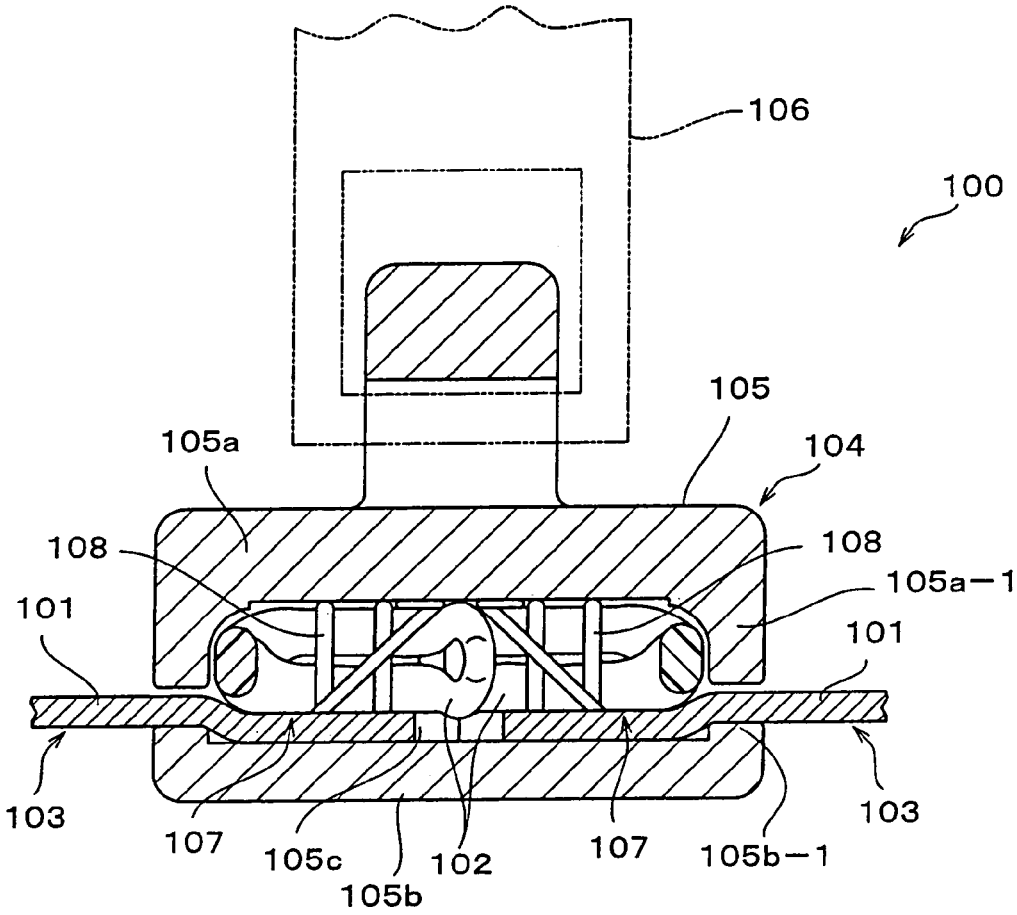
FIG. 8 PRIOR ART
FIG. 8 is a lateral sectional view of a slider mounting portion in a conventional normal type slide fastener.
Figure 9:
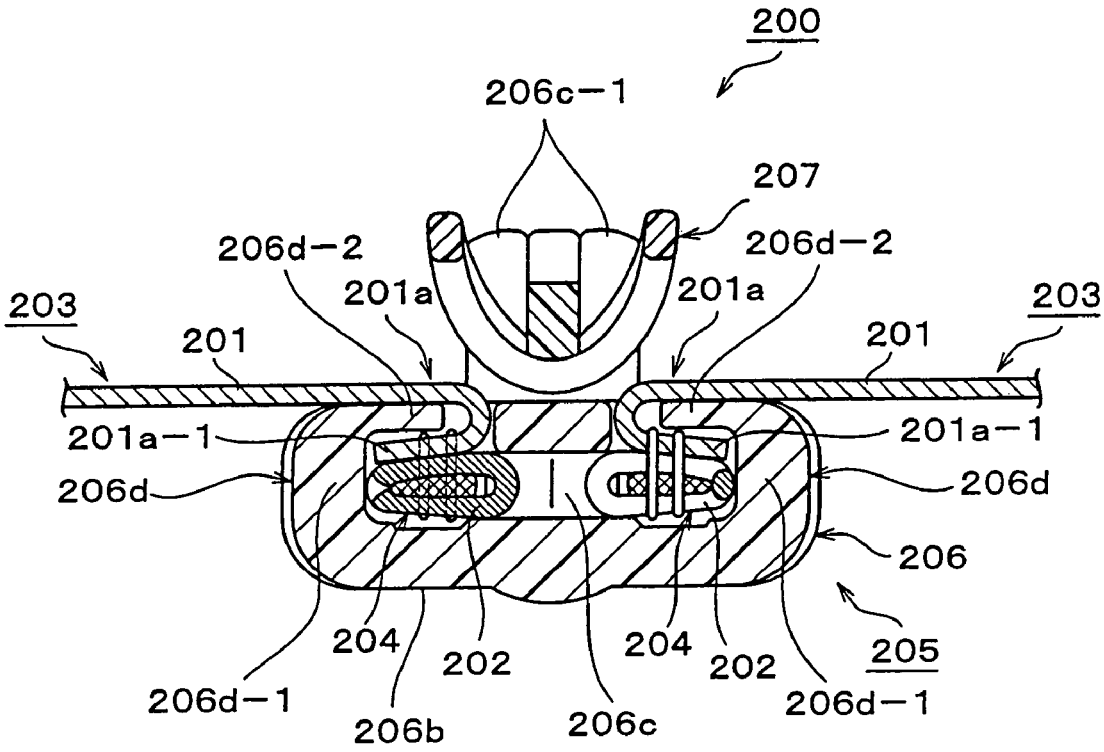
FIG. 9 PRIOR ART
FIG. 9 is a lateral sectional view of a slider mounting portion in a conventional concealed type slide fastener.

In the normal type slide fastener slider 105 shown in FIG. 8 and the conventional ordinary concealed type slide fastener slider 205 shown in FIG. 9, each of the guide passages for the fastener elements is set to a height allowing the fastener element row 104, 204 and the fastener tape 101, 201 composed of a single sheet to be passed through. On the other hand, in the slider 20 for the concealed type slide fastener of the invention, as exemplified specifically in FIG. 2, the guide passage 28 for the fastener elements 14 is set to a height allowing the fastener element row 12 and the folded-back side edge portion 15*a* which has double structure produced by folding back the fastener tape 11 to be passed through, which is a prominent difference.

Figure 4:
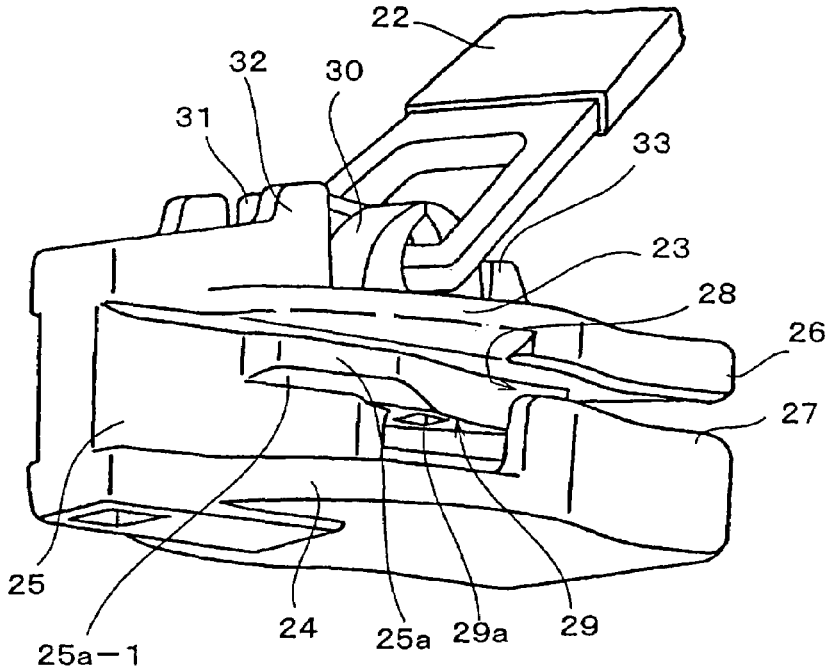
FIG. 4 is a perspective view of the same slider as seen from a lower side.
Figure 5:
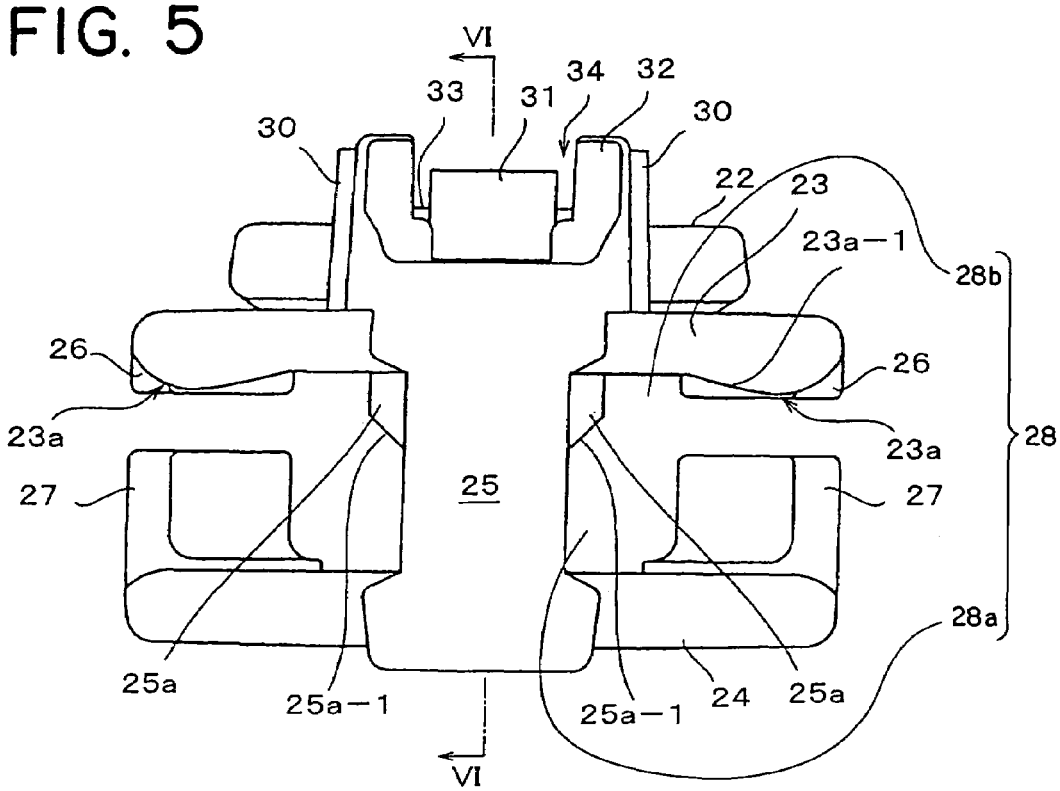
FIG. 5 is a front view of the same slider as seen from a shoulder mouth side.

According to the example shown in the same Figure, on corners defined by the bottom face of the upper blade 23 and the right and left side faces of the connecting post 25, there are provided protrusions 25*a* which are protruded outward to the right and left outer sides, those protrusions being extended from the shoulder mouth side of the slider 20 in which the right and left fastener element rows 12 are moved in a separate condition toward the rear mouth side in which the right and left fastener element rows 12 are moved in an engagement condition. On the upper blade 23, land portions 29 are formed, each of which is narrowed gradually from an end face on the rear moth side of the connecting post 25 toward the rear mouth and the front end of the protrusion 25*a* is continuously connected to the proximal end of the land portion 29. Further, the bottom face of each of the right and left protrusions 25*a* is formed as an inclined face 25*a*-1 which is inclined upward in the right or left direction as shown in FIG. 5. According to this embodiment, as shown in FIGS. 4, 5, expanded rows 23*a* are extended on the bottom faces of the right and left side edge portions of the upper blade 23, each expanded row being inclined downward in an outward direction.

On the other hand, a pair of right and left pull tab holding posts 30 are provided protrudedly on the top face of the upper blade 23 and a shaft portion 22*a* of the pull tab 22 is supported between the right and left pull tab holding posts 30. A cam face 22*b* is formed in the peripheral face in the center of this shaft portion 22*a* and a pawl portion 31*a* of a locking pawl provided spring 31 described later is moved vertically by a rotation of the pull tab 22 so that it engages or disengages one fastener element row 12 of the right and left fastener stringers 18 engaged within the slider 20 so as to disable the sliding of the slider 20 or enables the sliding thereof. For this reason, a pawl through hole 29*a,* which the pawl portion 31*a* is capable of passing through, is formed in the center of the land portion 29. The locking pawl provided spring 31 is composed of a leaf spring piece bent to two stages as shown in FIG. 6 and the pawl portion 31*a* is projected downward substantially at right angle from the front end of its upper stage.

Figure 6:
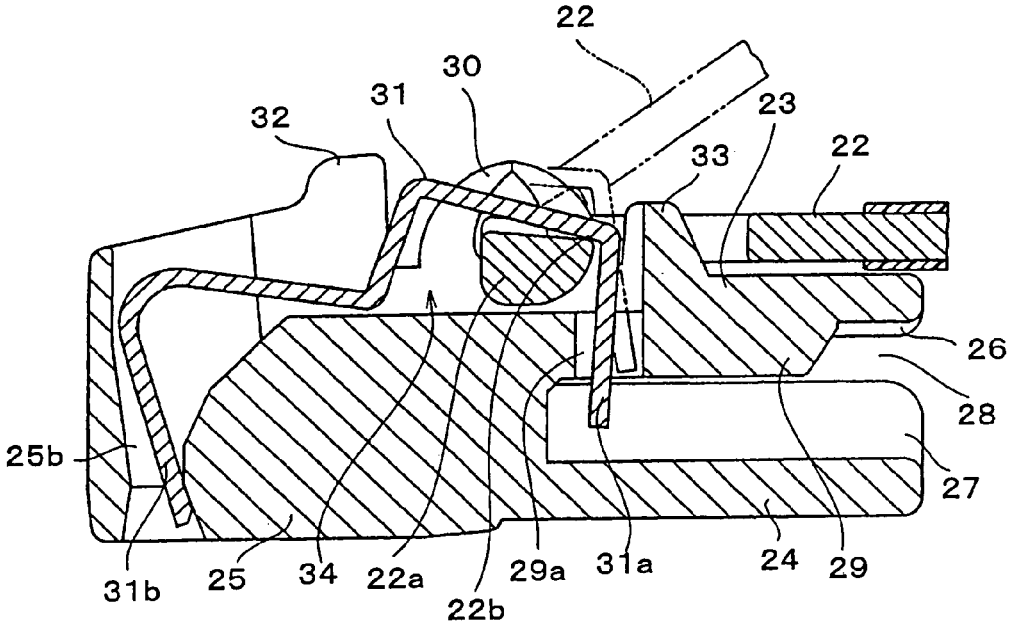
FIG. 6 is a sectional view taken along the line VI-VI in FIG. 5.

To mount the locking pawl provided spring 31 onto the slider 20, as shown in FIG. 6, a front post 32 and a rear post 33 are formed behind and before the right and left pull tab holding posts 30 in pair on the top face of the upper blade 23 and a spring accommodating groove 34 for accommodating the locking pawl provided spring 31 is formed from the front end of the rear post 33 to the front end of the connecting post 25. At the rear end portion of this accommodating groove 34 is formed the pawl portion through hole 29*a* as well as in the front end face of the rear post 33, the pawl portion through hole 29*a* going through and at the front end portion of the spring accommodating groove 34 is also formed a spring engagement hole 25*b* which a proximal end portion 31*b* on an opposite side to the pawl portion 31*a* of the locking pawl provided spring 31 engage, so as to go through the connecting post 25. The rear post 33 is erected adjacent to the rear face of the right and left pull tab holding posts 30 in pair and in the center thereof and the front post 32 is erected adjacent to the front face of the pull tab holding posts 30 with the locking pawl provided spring 31 sandwiched, including right and left rising walls in pair extended above the connecting post 25.

The mounting structure of the pull tab 22 and the locking pawl provided spring 31 is substantially not different from the mounting structure disclosed in for example Japanese Utility Model Application Publication No. 63-1854 and therefore, please refer to the same publication if necessary.

According to the concealed type slide fastener 10 of this embodiment having the above-described structure, the Y-shaped guide passage 28 formed between the upper and lower blades 23, 24 with the connecting post 25 has a height and width allowing the folded-back side edge portion 15 of the fastener tape 11 and the fastener element rows 12 to be passed through sufficiently. Thus, with the folded-back side edge portion 15 of the fastener tape 11 and the fastener element rows 12 passed through the guide passage 28 and further the tape main body 16 of the fastener tape 11 passed through the gap formed between the upper and lower blades 23, 24, the slider is slid in the back and forth direction. Thus, in the concealed type slide fastener 10 of this embodiment, the top face of the upper blade 23 is exposed on the surface and seems not different from ordinary slide fastener just at a glance. However, if looking at the right and left fastener stringers 18, no sewing thread 17 is exposed on the surface at opposing end portions of the right and left fastener tapes 11 as shown in FIGS. 1 and 8, so that an extremely excellent appearance is secured. Particularly if this embodiment is mounted on sport shoes, sport gears and clothes used under severe conditions, when the concealed type slide fastener 10 of this embodiment is closed, butting portions of the fastener stringers 18 make firm contact securely thereby obtaining a secure waterproofness.

To slide the concealed type slider 20 of this embodiment on right and left fastener stringers 18 in the back and forth direction along the length direction, if the pull tab 22 is rotated upward as indicated with a phantom line in FIG. 6, the shaft portion 22*a* is also rotated and the locking pawl provided spring 31 is rotated upward with respect to the proximal end portion 31*b* by the cam face 22*b* so that the locking pawl provided spring 31 is brought up. In addition, the pawl portion 31*a*, which remains projected into the guide passage 18 formed between the upper and lower blades 23, 24, is introduced from pawl portion through hole 29*a* formed in the upper blade 23 into the interior of the same pawl portion through hole 29*a* so as to release an engagement of the pawl portion 31*a* with fastener elements (not shown) adjoining in the length direction in conditions in which it penetrates therein, thereby enabling the slider 20 to slide. If the pull tab 22 is fallen to a parallel condition to the top face of the upper blade 23 as indicated with a solid line in FIG. 6, the locking pawl provided spring 31 is restored to its original shape by the cam face 22*b* of the shaft portion 22*a*. Consequently, the pawl portion 31*a* is projected from the pawl portion through hole 29*a* into the guide passage 28 between the upper and lower blades 23, 24 and then, penetrates into between fastener elements (not shown) adjoining in the length direction and engages thereby disabling the slider 20 from sliding.

According to this embodiment, if the slider 20 is moved to the shoulder mouth (forward), fastener element rows 12 passed through together along the guide passage 28 formed between the upper and lower blades 23, 24 and the right and left fastener element rows 12 on right and left folded-back side edge portions 15 are moved relatively to the rear mouth. The fastener stringers 18 in separate condition are engaged with each other when they pass through the land portion 29, so that the slide fastener 10 is closed. Conversely, if the slider 20 is moved to the rear mouth (backward), the fastener element rows 12 passed through along the guide passage 28 formed between the upper and lower blades 23, 24 and the right and left fastener element rows 12 in engagement condition on the right and left folded-back side edge portions 15 are disengaged by the connecting post 25 while they are moved from the rear mouth side to the shoulder mouth side, so that the right and left fastener stringers 18 are separated to open the slide fastener 10.

FIG. 2 is a sectional view of the concealed type slide fastener as seen from the rear mouth of the slider 20 and as understood from the same figure, the right and left fastener element rows 12 are in engagement condition. At the same time, the folded-back side edge portions 15 of the right and left fastener tapes 11 are passed through the guide passage 28 between the upper and lower blades 23, 24 in conditions in which the tape main body 16 and the folded-back piece 15*a* overlap and the folded-back ends keep firm contact with each other. On the other hand, FIG. 7 shows a condition in which the folded-back side edge portions 15 of the right and left fastener tapes 11 are passed through the guide passage 28 between the upper and lower blades 23, 24 in conditions in which the tape main body 16 and the folded-back piece 15*a* overlap each other while the right and left fastener element rows 12 are not in engagement condition.

Figure 7:
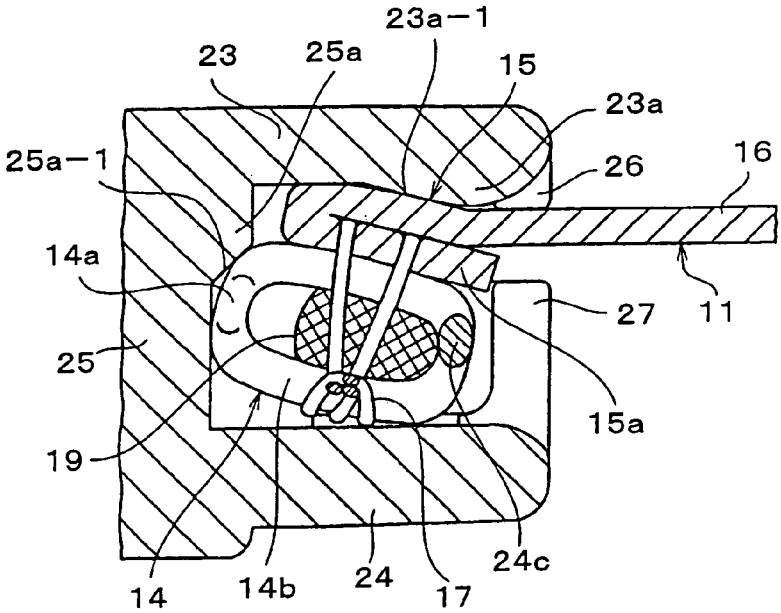
FIG. 7 is a sectional view of a half portion of the slide fastener of the embodiment.

FIG. 7 shows a condition in which the fastener element rows 12 are moving relatively on the side faces of the connecting post 25 of the slider 20. Often the right and left fastener tapes 11 of the slide fastener are pulled to the right and left sides, or, to opposite directions laterally. As a result, in case of the concealed type slide fastener 10 of the present invention, the fastener elements 14 may be tilted largely while their coupling heads 14*a* are raised within the guide passage 28 by such a lateral pulling force of the right and left fastener tapes 11. If the fastener elements 14 are raised in this way, the coupling heads 14*c* of the right and left fastener elements 14, which are about to engage when they pass over the land portions 29, are deflected in posture and consequently, they cannot engage properly.

According to this embodiment, to avoid such a flaw, the protrusion 25*a* is projected from the upper side face of the connecting post 25 up to the land portion 29 as shown in FIG. 7. Further, the bottom face of this protrusion 25*a* is formed as the inclined face 25*a*-1 which is inclined upward from an inner side of the guide passage 28 toward an outer side thereof. Due to existence of this inclined face 25*a*-1, the posture is changed smoothly against a strong force generated by the lateral pulling force of the fastener tape 11 thereby protecting the fastener elements 14 from damage. Further, according to this embodiment, the expanded row 23*a* is extended obliquely downward up to the shoulder mouth side end of the flange 26 from the inner side of the guide passage 28 toward an outer side thereof, i.e., from halfway of the bottom face of the upper blade 23 to a side end of the upper blade 23 at a position corresponding to the protrusion 25*a*.

When the lateral pulling force is applied to the fastener tape 11 so that the fastener elements 14 are about to be raised due to the existence of the expanded portion 23*a*, the folded-back side edge portion 15 of the fastener tape 11 makes contact with the expanded inclined face 23*a*-1 of the expanded portion 23*a*, so that friction resistance due to that face contact increases thereby preventing the fastener elements 14 from being inclined further. As a result, the sliding operation of the slider 20 is carried out smoothly and at the same time, the fastener elements 14 can be securely engaged or disengaged. Further, the inside face of the folded-back end of the fastener tape does not make a sliding contact with the edge of a horizontal portion of the inverted L shaped flange unlike the conventional concealed type slide fastener so that the durability of the fastener tape can be increased.

According to this embodiment, the gap between the respective flanges 26 and 27 of the upper blade 23 and the lower blade 24 is set to such a dimension allowing the fastener tape main body 16 except the folded-back side edge portion 15 to be passed through. Thus, accommodation style for the folded-back side edge portion 15 and the fastener element rows 12 of the fastener tape 11 moved through the guide passage 28 in the slider 20 is not changed largely, thereby enabling the slider to be slid further smoothly.

By provision of the protrusion 25*a* as described above, an element guide space for guiding the fastener element row 12 is defined between the bottom end inclined face 25*a*-1 of the protrusion 25*a* and the lower blade 24 and further, a space surrounded by the side face of the protrusion 25*a*, the element guide space and the upper blade 23 is defined as a tape-side-edge-portion guide space for accommodating and guiding the folded-back side edge portion 15 of each fastener tape 11. That is, the guide passage 28 is sectioned as the element guide space 28*a* and the tape-side-edge-portion guide space 28*b*. As a result, the fastener element row 12 is guided and slid through the element guide space 28*a* existing at the bottom of the guide passage 28 while the folded-back side edge portion 15 of each of the right and left fastener tapes 11 is slid and guided through the tape-side-edge-portion guide space 28*b* defined independently above the element guide space 28*a* in which the fastener element row 12 is moved.

Figure 10:
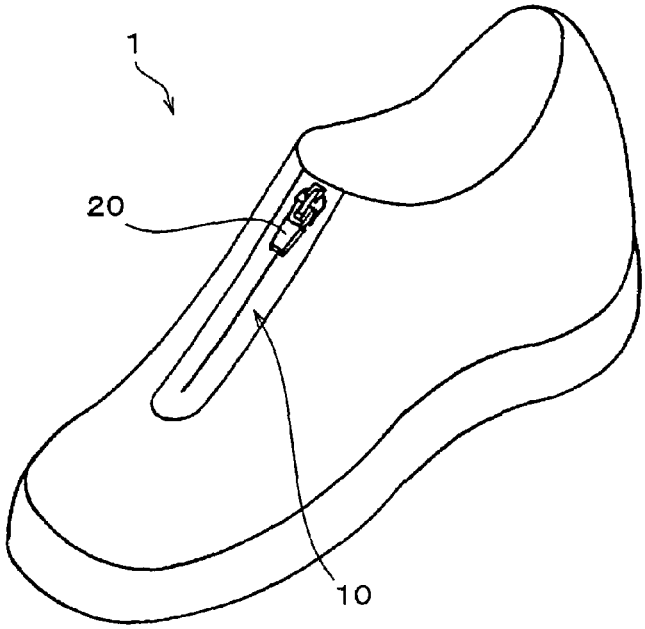
FIG. 10 is a perspective view showing an appearance of a shoe equipped with the concealed type slide fastener with the slider of the invention.
Figure 11:
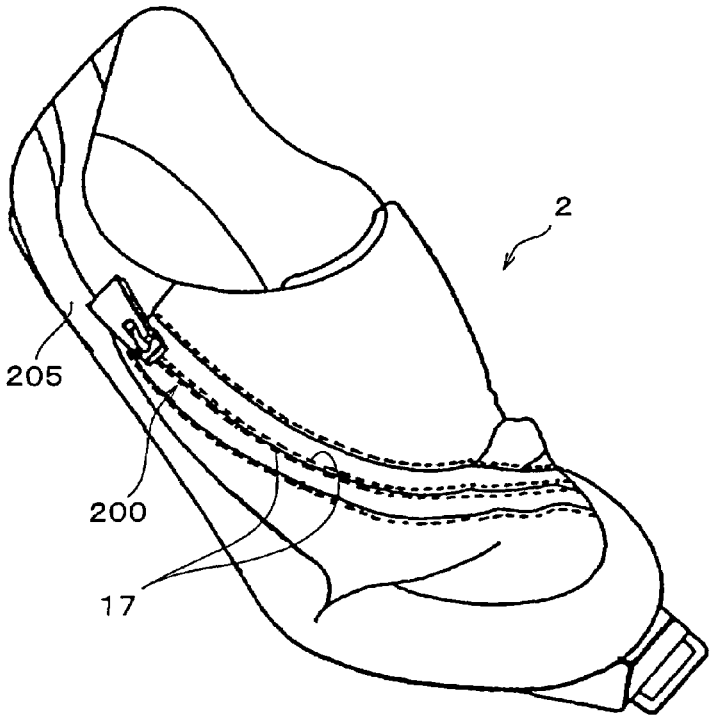
FIG. 11 PRIOR ART
FIG. 11 is a perspective view showing the appearance of a shoe equipped with a conventional slide fastener with a slider.

FIGS. 10, 11 show an example of a shoe 1 equipped with the concealed type slide fastener with slider of the present invention and an example of a shoe 2 equipped with the conventional slide fastener with slider. The shoe 2 shown in FIG. 11 is equipped with the concealed type slide fastener 200 with the conventional slider 205 disclosed in the patent document 2. The shoe 1 shown in FIG. 10 is equipped with the concealed type slide fastener 10 with the slider 20 of the present invention.

As understood from these figures, in case of the shoe 1 equipped with the concealed type slide fastener 10 of the present invention, the element sewing thread 17 of the concealed type slide fastener 10 is not exposed outside at all. Therefore, not only no water invades into the inside through any seam line but also the ends of the folded-back side edges portions of the right and left fastener tapes keep firm contact with each other as described previously and as a consequence, no water invades through gaps between the right and left ends. As a result, the entire waterproofness is improved. Contrary to this, in case of the conventional shoe 2, the sewing thread 17 of the fastener element is exposed outside and thus, water easily invades through the seam line. As a consequence, not only water penetrates into the interior of the shoe 2 through the gaps in the fastener elements but also several lines of the sewing threads are produced outside thereby making redundant in fashion viewpoints.

What is claimed is:

1. A slider for a concealed type slide fastener, the slider, comprising:

the slider engaging and disengaging respective fastener element rows of the concealed type slide fastener, the concealed type slide fastener having respective folded-back side edge portions in a double structure created by folding back opposing side edge portions of a pair of right and left fastener tapes to a rear face side into a U shape, coupling heads of fastener elements disposed along folded-back edges of the fastener tapes, leg portion sides of the fastener elements disposed alone front end portions of folded-back pieces, and leg portions fixed to the folded-back pieces of a rear side of respective folded-back side edge portions, wherein the slider a comprises:

an upper blade and lower blade connected through a connecting post;

lower flanges provided at right angle to respective right and left side edges of the lower blade and approaching toward the upper blade; and between the upper blade and the lower blade, guide passages for simultaneously guiding the respective folded-back side edge portions in the double structure of the fastener tapes and the respective fastener element rows in an engageable/disengageable posture.

2. The slider for the concealed type slide fastener according to claim 1, wherein protrusions, which are disposed along top portions of right and left side faces of the connecting post and on the upper blade so as to be protruded from the upper blade toward the lower blade, is provided.

3. The slider for the concealed type slide fastener according to claim 2, wherein element guide spaces for guiding the fastener element rows in the engageable/disengageable posture are formed between bottom end faces of the protrusions and the lower blade, and the spaces surrounded by side faces of the protrusions, the element guide spaces and the upper blade constitute tape-side-edge-portion guide spaces for accommodating and guiding the folded-back side edge portions of the respective fastener tapes, while the engageable/disengageable posture of the fastener element rows are maintained.

4. The slider for the concealed type slide fastener according to claim 2, wherein the bottom end faces of the protrusions are formed as inclined faces, each of the inclined faces being inclined upward from an inner side of each of the guide passages toward an outer side thereof.

5. The slider for the concealed type slide fastener according to claim 1, wherein expanded rows are extended on bottom faces of right and left portions of the upper blade in a back and forth direction of the slider, the expanded rows being expanded obliquely downward from an inner side of each of the guide passages toward an outer side thereof.

6. The slider for the concealed type slide fastener according to claim 1, wherein a gap in a vertical direction at each of right and left side edges of the upper blade and the lower blade is set to a dimension allowing only a fastener tape main body except each of the folded-back side edge portions to be passed through.

7. A concealed type slide fastener comprising:

a pair of right and left fastener tapes including folded-back side edge portions in a double structure created by being folded back to a rear face side into a U shape along side edges thereof and including tape main bodies except the side edge portions; right and left fastener element rows in which coupling heads of fastener elements are disposed along folded-back edges of the fastener tapes, leg portions of the fastener elements are disposed along front end portions of folded-back pieces on an opposite side of the tape main bodies, and leg portions are fixed to the folded-back pieces of the folded-back side edge portions of the fastener tapes; and a slider which is slid along the fastener element rows and carries out an engagement/disengagement of the right and left fastener element rows, wherein the slider has an upper blade and a lower blade connected by a connecting post, and flanges provided at right angle to right and left side edges of the lower blade and approaching to the upper blade, and between the upper blade and the lower blade, guide passages for simultaneously guiding the respective folded-back side edge portions in the double structure of the fastener tapes and the respective fastener element rows attached to the folded-back pieces in and engageable/disengageable posture.

8. The concealed type slide fastener according to claim 7, wherein the leg portions are fixed only to the folded-back pieces.

9. The concealed type slide fastener according to claim 7, wherein the leg portions are fixed to the folded-back pieces by sewing threads.

* * * * *